United States Patent [19]

Osawa et al.

[11] Patent Number: 4,681,825

[45] Date of Patent: Jul. 21, 1987

[54] ELECTROPHOTOSENSITIVE MEMBER HAVING AN AMORPHOUS SILICON-GERMANIUM LAYER

[75] Inventors: Izumi Osawa, Ikeda; Isao Doi, Toyonaka; Toshiya Natsuhara, Amagasaki, all of Japan

[73] Assignee: Minolta Camera Kabushiki Kaisha, Osaka, Japan

[21] Appl. No.: 753,589

[22] Filed: Jul. 10, 1985

[30] Foreign Application Priority Data

Jul. 16, 1984 [JP] Japan ..... 59-147918

[51] Int. Cl.[4] ..... G03G 5/082

[52] U.S. Cl. ..... 430/57; 430/84; 430/95

[58] Field of Search ..... 430/57, 84, 95

[56] References Cited

U.S. PATENT DOCUMENTS

| | | | |
|---|---|---|---|
| 4,491,626 | 1/1985 | Kawamura et al. | 430/57 |
| 4,495,262 | 1/1985 | Matsuzaki et al. | 430/84 |
| 4,513,073 | 4/1985 | Jeffrey et al. | 430/65 |

*Primary Examiner*—John L. Goodrow

*Attorney, Agent, or Firm*—Burns, Doane, Swecker & Mathis

[57] ABSTRACT

The present invention provides an electrophotosensitive member comprising laminating a layer composed substantially of amorphous silicon, a layer composed substantially of amorphous silicon:germanium and a layer composed substantially of amorphous silicon in this order on an electroconductive substrate, an electrophotosensitive member comprising laminating a layer composed substantially of amorphous silicon, a layer composed substantially of amorphous silicon:germanium and a layer composed substantially of amorphous silicon in this order on an electroconductive substrate, characterized in that said layer composed substantially of amorphous silicon:germanium is situated away from said substrate by a range of 20 to 80% based on the total thickness of these layers.

According to the present invention, it is improve defect of the amorphous silicon:germanium such that it is easy to generate thermally excited carriers and low in the carrier-carrying efficiency problems such as reduction of sensitivity and generation of light fatigue and residual potential are easy to occur.

11 Claims, 10 Drawing Figures

ELECTROPHOTOSENSITIVE MEMBER HAVING AN AMORPHOUS SILICON-GERMANIUM LAYER

BACKGROUND OF THE INVENTION

The present invention relates to electrophotosensitive members, particularly amorphous silicon:germanium photosensitive members.

Amorphous silicon:germanium (hereinafter referred to as a-Si:Ge), because of its high sensitivity toward long wavelength light, is expected for the future as a photosensitive member for printers using semi-conductor laser. Also, since its sensitivity toward short-wave light is not damaged, it can be applied to plain paper copiers (hereinafter referred to as PPC) by regulating the emission spectrum of exposure lamps. Also, a-Si:Ge has excellent feature that, because of its layer well absorbing long wavelength light, there is little disturbance of images by interference of light frequently encountered in the conventional amorphous silicon (a-Si) photosensitive members. Because of these features, many studies for applying a-Si:Ge to photosensitive members are being made.

For example, there are disclosed a technique to use a-Si:Ge over the whole region of photosensitive layer [Japanese Patent Application Kokai (Laid-open) No. 171038/1983]; a technique to apply a-Si:Ge directly on a conductive base of photosensitive member (U.S. Pat. No. 4,490,450); and a technique to apply a-Si:Ge to a layer in direct contact with the surface layer and/or substrate of photosensitive member (ibid., No. 150753/1981). But, either of these techniques is different from the present invention in a position to apply a-Si:Ge. For example, said patent application No. 171038/1983 includes the formation of a-Si:Ge layer over the whole region of photosensitive layer, but a-Si:Ge has its own defect that it is small in $\mu\tau$ (carrier range) and low in carrier-carrying efficiency. When a-Si:Ge is therefore applied over the whole region of photosensitive layer, generated carriers are trapped by the a-Si:Ge layer to cause not only reduction of sensitivity, but also generation of light fatigue and residual potential.

Also, as described in said U.S. Pat. No. 4,490,450 and in Japanese Patent Application Kokai (Laid-open) No. 150753/1981, when the a-Si:Ge layer has been applied as the base of photosensitive layer, because of a-Si:Ge being easy to generate thermally excited carriers, injection of carriers at the base becomes easy to cause reduction of charging capability. Besides, when the thickness of the a-Si:Ge layer is made large in order to eliminate interference patterns generated in printers using semiconductor laser ray or long-wave coherent light as a light source, carriers present in the vicinity of the base are trapped by the a-Si:Ge layer to cause reduction in sensitivity and generation of light fatigue and residual potential.

Further, as disclosed in Japanese Patent Application Kokai (Laid-open) No. 150753/1981, when the a-Si:Ge layer has been applied to the outermost surface of photosensitive members, carriers excited by short-wave light cannot migrate to move out of the layer to fail to contribute to sensitivity. While, when the thickness of the a-Si:Ge layer is made large in order to inhibit interference of light, carriers are trapped in the layer. Also, a-Si:Ge generates a large number of thermally excited carriers to cause injection of charges from the surface and this obviously lowers the charging capability.

For this reason, the foregoing conventional techniques do not make the best use of the excellent characteristics of a-Si:Ge.

On the other hand, Japanese Patent Application Kokai (Laid-open) No. 154850/1983 discloses an example of providing triple layers of a-Si:Ge to form the photosensitive member which has a photosensitivity extending to the long wavelength region. But the object of this photosensitive member is to control specific resistance and conductivity. This patent application does not refer at all to selection of the position of a-Si:Ge for solving the problems encountered in using a-Si:Ge, i.e. a reduction in carrier-carrying efficiency accompanied by reduction of sensitivity and generation of light fatigue and residual potential.

SUMMARY OF THE INVENTION

Because of the high sensitivity toward long-wave light (e.g. 780 nm), a-Si:Ge is not only useful as a photosensitive members for printers using semiconductor laser ray, but also, because it has also sensitivity toward short-wave light, can be applied to PPC by regulating the emission spectrum of exposure lamps. Since, however, a-Si:Ge is easy to generate thermally excited carriers and low in the carrier-carrying efficiency, problems such as reduction of sensitivity and generation of light fatigue and residual potential are easy to occur, so that the foregoing characteristics of a-Si:Ge are not fully made of use. In order to dissolve the above problems, present invention provides an electrophotosensitive member comprising laminating a layer composed substantially of amorphous silicon, a layer composed substantially of amorphous silicon:germanium and a layer composed substantially of amorphous silicon in this order on an electroconductive substrate, characterized in that said layer composed substantially of amorphous silicon:germanium is situated in a position within a range of 20 to 80% from the surface of said substrated based on the total thickness of three layers. According to the present invention, it is provided electrophotosensitive members having the characteristics of a-Si:Ge fully made use of by solving the foregoing defects of a-Si:Ge.

between the light and dark parts produced by interference.

DETAILED DESCRIPTION OF THE INVENTION

The present invention provides an electrophotosensitive member comprising laminating a layer composed substantially of amorphous silicon, a layer composed substantially of amorphous silicon:germanium and a layer composed substantially of amorphous silicon in this order on an electroconductive substrate, an electrosensitive member characterized in that said layer composed substantially of amorphous silicon:germanium is situated in a position within a range of 20 to 80% from the surface of said substrated based on the total thickness of three layers.

Figure 1:
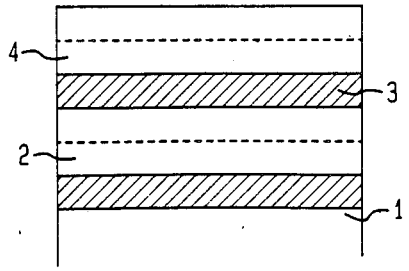
FIG. 1 shows a typical sectional view of the photosensitive member of the present invention.

The typical embodiment of the present invention will be shown in FIG. 1. In the figure, (1) is a substrate, (2) is a layer composed substantially of amorphous silicon (hereinafter referred to as a-Si layer), (3) is a layer composed substantially of amorphous silicon:germanium (hereinafter referred to as a-Si:Ge layer) and (4) is an a-Si layer. The dotted lines in FIG. 1 denote the range of 20 to 80% within which the a-Si:Ge layer (2) is positioned and this range of 20 to 80% is calculated from the surface of the substrate (1) based on the total thickness of these three layers (2), (3) and (4).

In the present invention, a reason why the a-Si:Ge layer is sandwiched between the a-Si layers is to make it easy for carriers generated in the a-si:Ge layer to move into both the upper and lower layers, thereby making it difficult for the carriers to be trapped within the a-Si:Ge layer. As described above, a-Si:Ge is small in $\mu\tau$ and the carrier generated in the a-Si:Ge layer is slow in the moving rate, and therefore the thickness of the a-Si:Ge layer could not be made large. Particularly, when the a-Si:Ge layer has been placed in contact with the outermost layer as in the prior-art techniques, the carrier can move toward only one side to fail to contribute to the sensitivity. Also, injection of charges from the surface becomes easy to cause a reduction in charging capability. Similarly, when the a-Si:Ge layer has been placed in contact with or near the substrate, carriers generated in the lower layer are trapped by the a-Si:Ge layer before moving into the upper a-Si layer. Also, injection of charges from the substrate becomes easy to lower the charging capability.

In the present invention, by sandwiching the a-Si:Ge layer between the a-Si layers, carriers generated in the a-Si:Ge layer can move into the both a-Si layers, so that the number of trapped carriers becomes small. Consequently, the thickness of the a-Si:Ge layer can be made large and the interference of light can be prevented. Also, injection of charges from the surface layer and substrate is inhibited so that reduction in charging capability can be prevented.

In the present invention, the a-Si:Ge layer is situated away from the electroconductive substrate by a range of from 20 to 80%, preferably from 30 to 75% based on the total thickness of the layers. When the layer is placed within 20% of the total thickness from the substrate, injection of charges becomes easy, the charging capacity lowers and besides the contribution of generated carriers to sensitivity becomes poor. Similarly, when the layer is placed beyond 80% of the total thickness from the substrate, i.e. within 20% of the total thickness from the surface layer, problems of charging capability and sensitivity occur.

The thickness of the a-Si:Ge layer is preferably made 100 Å to 20 $\mu$m. When the thickness is less than 100 Å, the sensitivity toward long wavelength light based on a-Si:Ge lowers so that application to laser beam printer (hereinafter referred to as LBP) becomes impossible. While, when it is more than 20 $\mu$m, generation of light fatigue becomes easy and residual potential tends to rise.

The Ge atom concentration in the a-Si:Ge layer is preferably within a range of 2 to 70 atomic % (hereinafter referred to as at %), more preferably 8 to 50 at % based on the total number of Si atoms and Ge atoms. When the Ge atom concentration is small, the thickness of the layer may be made large.

A relationship between the thickness of the a-Si:Ge layer (3) which is represented by a-$Si_{(1-x)}$:$Ge_xH$ (x:number of Ge atoms expressed by a ratio of Ge/(Si+Ge)) and the Ge concentration x satisfied the following equation:

$$0.07 \leqq dx^2 \leqq 0.90$$

When $dx^2$ is smaller than 0.07, problems due to interference of light are easy to occur, and when it is larger than 0.90, the charging capability lowers. Generally, since the charging capability is preferably made not less than 17 V/$\mu$m $dx^2$ is preferably made not more than 0.90.

As apparent from the above equation satisfied by the a-Si:Ge layer of the present invention, the thickness d is generally large when x is small or vice versa. The inclusion of a large amount of Ge will require less thickness of the layer (3) whereas a small amount of Ge will require more thickness.

The light characteristics of the a-Si:Ge layer may be improved by incorporating other elements such as carbon, oxygen, nitrogen, etc. in the layer. Incorporation of oxygen is effective in terms of improvement in charging capacity and reduction in light fatigue. The amount of oxygen is preferably made 0.01 to 5 at % based on Si atoms.

The polarity of the a-Si and a-Si:Ge layers (2), (3) and (4) may be regulated by incorporating an atom belonging to Group III or V of the periodic table in said layers. As the atom of Group III, the atom of Group IIIA, particularly boron is preferred. As the atom of Group V, the atom of Group VA, particularly phosphorus is preferred.

The amount of the atom of Group III which may be incorporated in each of the layer is preferably not more than 200 ppm, more preferably 3 to 100 ppm based on the Si atom. The amount of the atom of Group V incorporated is not more than 50 ppm, preferably 1 to 20 ppm.

When the photosensitive member is used in a positively charged state, it is preferred that the amount of the atom of Group III is made rich at the substrate side (i.e., in the a-Si layer (2)) and poor at the surface layer. Also, the surface layer (i.e., in the a-Si layer (4)) may be made of N-type and the substrate side may be made of P-type. a-Si and a-Si:Ge themselves are of N-type, but small amounts of the atom of Group V (e.g. phosphorus) may be added to make them of stronger N-type. In this way, electrons generated in the a-Si:Ge layer (3) move through the upper a-Si layer (4) to neutralize surface charges and holes move through the lower a-Si layer (4) without being trapped. Further, injection of positive charges from the surface of the a-Si layer (4)

and negative charges from the substrate (1) is effectively prevented.

When the photosensitive member is used in a negatively charged state, it is preferred that the amount of the atom of Group III is made poor at the substrate side and rich at the surface layer. Also, by incorporating the atom of Group V in the substrate side, the surface layer may be made of P-type and the substrate side may be made of N-type.

By taking the arrangement like this, the backward bias effect of photosensitive members on charge-induced polarity is enhanced, and as a result, effects to improve the charging capability and reduce the residual potential can be obtained.

In the photosensitive member of the present invention, the a-Si layers (2) and (4) are placed at the upper and lower sides of the a-Si:Ge layer. By taking this arrangement, movement of carriers generated in the a-Si:Ge layer becomes easy, and injection of charges at both the surface and substrate. is inhibited to improve the charging capability.

The thickness of each a-Si layer is 1 to 50 μm, more preferably 5 to 30 μm. When it is less than 1 μm, the charge injection-inhibiting effect at the time of charging becomes poor to cause reduction in charging capacity. When it is more than 50 μm, there appear adverse effects that the movement distance of carriers becomes so long that opportunity for the carrier to be trapped increases, and therefore that a rise in residual potential is caused.

Further, carbon, oxygen, nitrogen, etc. may be incorporated in the a-Si layers. Incorporating carbon in the a-Si surface layer (4) results in improvement in the moisture resistance of the surface as well as improvement in percent charge retention and light permeability. The carbon content is not less than 35 at %, particularly preferably not less than 50 at % based on the total amount of the Si and C atoms.

Oxygen and nitrogen are particularly useful to improve dark resistance and reduce light fatigue. Particularly, incorporating much oxygen in the a-Si layer (2) in contact with the substrate is effective to prevent charge injection at the substrate and improve the charging capability of the photosensitive member. The oxygen content is 0.05 to 5 at %, more preferably 0.1 to 2 at % based on the Si atom.

The photosensitive member of the present invention can be produced by the usual methods for example as follows: An a-Si layer is deposited on a substrate (e.g. aluminum) by applying glow discharge to a mixed gas comprising $SiH_4$, $Si_2H_6$, suitable carrier gases (e.g. $H_2$, Ar) and required hetero atoms; an a-Si:Ge layer is then deposited on the a-Si layer by applying glow discharge to a mixed gas comprising $SiH_4$, $GeH_4$ and hetero atoms; and similarly, an a-Si layer is deposited on the a-Si:Ge layer.

In the photosensitive member of the present invention, the a-Si:Ge layer (3) is sandwiched between layers (2) and (4) composed substantially of a-Si. As a result, since carriers generated in the a-Si:Ge layer can easily move into either of the upper or lower a-Si layer, the movement distance becomes short to decrease opportunity for the carrier to be trapped in the a-Si:Ge layer. As a result, reduction in residual potential can be attained. Also, since the a-Si layer is sandwiched between the a-Si:Ge layer and either of the substrate or the surface, the injection of charges is inhibited and the charging capability is improved. A further improvement in charging capability can be attained by incorporating boron and phosphorus in the a-Si layer to give backward bias thereto. Also, since the a-Si:Ge layer having a strong tendency to trap the carrier is not present in the vicinity of the surface layer and substrate, movement of the carrier into both the upper and lower layers is not disturbed. As a result, improvement in the sensitivity is remarkable.

Besides, adverse effects resulting from interference of light as well as the charging capacity can be improved by adjusting $dx^2$ of the a-Si:Ge layer within a range of from 0.07 to 0.90.

The present invention will be illustrated hereinafter with reference to the following examples.

EXAMPLE 1

Figure 2:
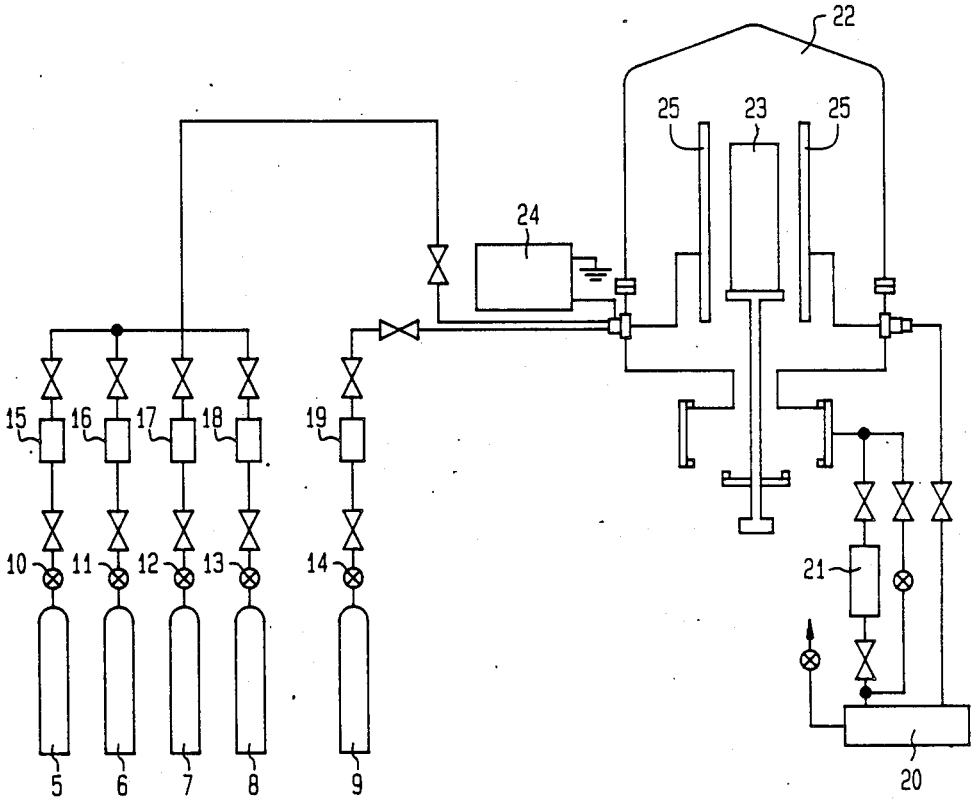
FIG. 2 shows a glow discharge decomposition apparatus for manufacturing the photosensitive member of the present invention.

Step (1):

In a decomposition apparatus with glow discharge shown in FIG. 2, the inner part of the reactor (22) is exhausted to a high vacuum of about $10^{-6}$ Torr by operating first a rotary pump (20) and then a diffusion pump (21). After opening the 1st to 3rd and 5th controlling valves (10), (11), (12) and (14), $H_2$ gas in the 1st tank (5), 100% $SiH_4$ gas in the 2nd tank (6), $B_2H_6$ gas, diluted to 200 ppm with $H_2$, in the 3rd tank (7) and $O_2$ gas in the 5th tank (9) are sent to mass flow controllers (15), (16), (17) and (19), respectively, under an output gauge of 1 kg/cm$^2$. Thereafter, the flow amount of $H_2$, $SiH_4$, $B_2H_6/H_2$ and $O_2$ gases are set on 482 sccm (standard cubic cm/min), 100 sccm, 17 sccm and 1.0 sccm, respectively, by adjusting the scales of the respective mass flow controllers, and every gas is sent to the reactor (22). After the flow rate of every gas is stabilized, the inner pressure of the reactor (22) is adjusted to 1.0 Torr. Separately, an aluminum drum of 80 mm in diameter, an electroconductive substrate (23), in the reactor (22) is heated to 250° C. in advance. At the point when both the flow rate of every gas and the inner pressure are stabilized, a high-frequency power source (24) is turned on and a power of 250 watts (frequency, 13.56 MHz) is applied to electrodes (25) to generate glow discharge. This glow discharge is continued for 5.5 hours to deposit an a-Si photoconductive layer (2) of about 14 μm in thickness containing hydrogen, boron and a trace amount of oxygen on the electroconductive substrate (23) [(1) in FIG. 1].

Step (2):

At the point when the a-Si photoconductive layer is formed, application of power from the high-frequency power source (24) is stopped and at the same time, the flow amount of every mass flow controller is set on zero, and the reactor (22) is thoroughly degassed. Thereafter, 474 sccm of $H_2$ gas, 100 sccm of 100% $SiH_4$ gas, 5 sccm of $B_2H_6$ gas diluted to 200 ppm with $H_2$, 20 sccm of $GeH_4$ gas and 1.0 sccm of $O_2$ gas are sent to the reactor from the 1st, 2nd, 3rd, 4th and 5th tanks [(5), (6), (7), (8) and (9)] respectively. After adjusting the inner pressure to 1.0 Torr, the high-frequency power source is turned on to apply a power of 250 watts. Glow discharge is continued for 70 minutes to deposit an a-Si:Ge layer (3) of about 3 μm in thickness. The germanium content at that time is about 30 at %.

Step (3):

Procedure is carried out in the same manner as in Step (1) except that the flow amount of $H_2$ gas and $B_2H_6$ gas diluted to 200 ppm with $H_2$ are 494 sccm and 5 sccm, respectively, to deposit an a-Si layer (4). The thickness of the a-Si layer is determined to be 13 μm.

The photosensitive member thus obtained was set to a xerographic copying machine (EP 650Z; produced by Minolta Camera Co., Ltd.), and used for copying in a positively charged state. As a result, clear and high-density images superior in resolving power and good in gradation reproducibility were obtained. Continuous copying was carried out 50,000 times, but reduction in image characteristics was not observed, and good copies were obtained to the last. Further, copying was carried out under a high-temperature and high-humidity condition such as 30° C.×85%, but the electrophtographic characteristics and image characteristics did not differ at all from those under room temperature conditions.

COMPARATIVE EXAMPLE 1

In the same manner as in Example 1, a photosensitive member comprising an a-Si layer (2) of 26 μm thick, a-Si:Ge layer (3) of 3 μm thick and a-Si layer (4) of 1 μm thick is produced.

COMPARATIVE EXAMPLE 2

In the same manner as in Example 1, a photosensitive member comprising an a-Si layer (2) of 1 μm thick, a-Si:Ge layer (3) of 3 μm thick and a-Si layer (4) of 26 μm thick is produced.

The photosensitive members obtained in the foregoing example and comparative examples were charged at 600 V, and residual potential at the point when the charge was erased using a white fluorescent lamp (58 lux:sec), was measured. The result is shown in Table 1.

TABLE 1

| | Example 1 | Comparative example 1 | Comparative example 2 |
|---|---|---|---|
| Residual potential (V) | 5 | 120 | 20 |

It can be seen from the table that the residual potential of the photosensitive member of the present invention is very low.

COMPARATIVE EXAMPLE 3

A photosensitive member is produced in the same manner as in Example 1 except that Steps (2) and (3) are omitted, and that the thickness of the a-Si layer (2) is made 30 μm by Step (1) only.

COMPARATIVE EXAMPLE 4

A photosensitive member is produced in the same manner as in Example 1 except that Step (3) is omitted and the thickness of the a-Si layer (2) is made 27 μm.

COMPARATIVE EXAMPLE 5

A photosensitive member is produced in the same manner as in Example 1 except that Step (1) is omitted and the thickness of the a-Si layer (4) is made 27 μm.

Figure 3:
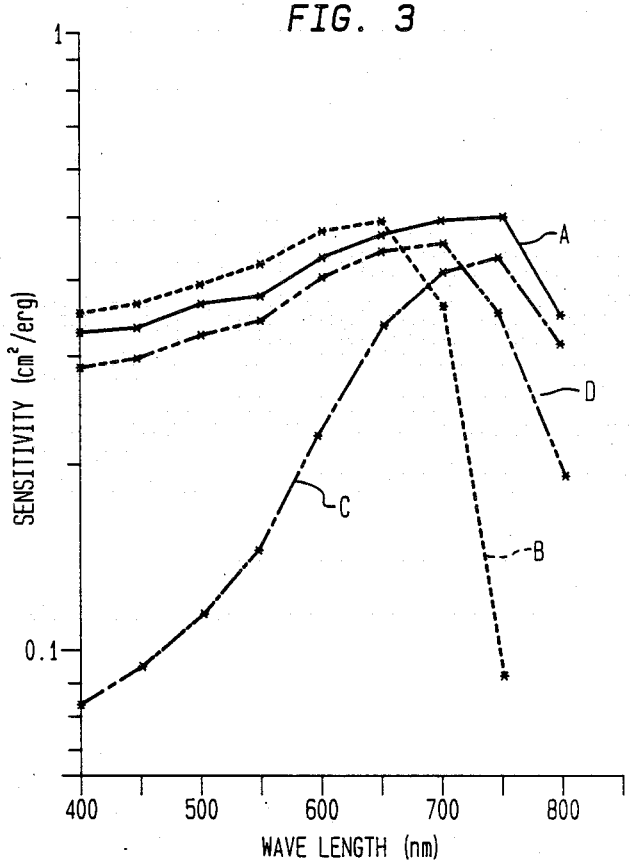
FIG. 3 shows graphs illustrating the relationship between wave-length and sensitivity of each of the present and conventional a-Si:Ge photosensitive members.

To the photosenistive members obtained in Example 1 and Comparative examples 3 to 5 was applied corona discharge at 600 V, and then spectral sensitivity was measured to obtain the result shown in FIG. 3. In the Figure, (A), (B), (C) and (D) show the results obtained with the photosensitive members in Exampel 1 and Comparative examples 3, 4 and 5, respectively. The abscissa shows wavelength (nm) and the ordinate shows sensitivity (scm/erg). As is apparent from FIG. 3, it can be seen that the photosensitive member of the present invention has high sensitivity toward long wavelength light, and besides that its sensitivity toward short-wave light is not damaged. Consequently, it can be used for both LBP and PPC.

Using the photosensitive member obtained in Example 1, practical copying was tried on LBP with semiconductor laser as a light source of 780 nm, and as a result, it was found that, even by high-speed printing, clear and high-quality images were obtained and conventionally observable density difference on images based on the interference phenomenon was not generated at all. Also, practical copying was tried on PPC to find that clear and high-quality images were obtained.

EXAMPLE 2

Figure 4:
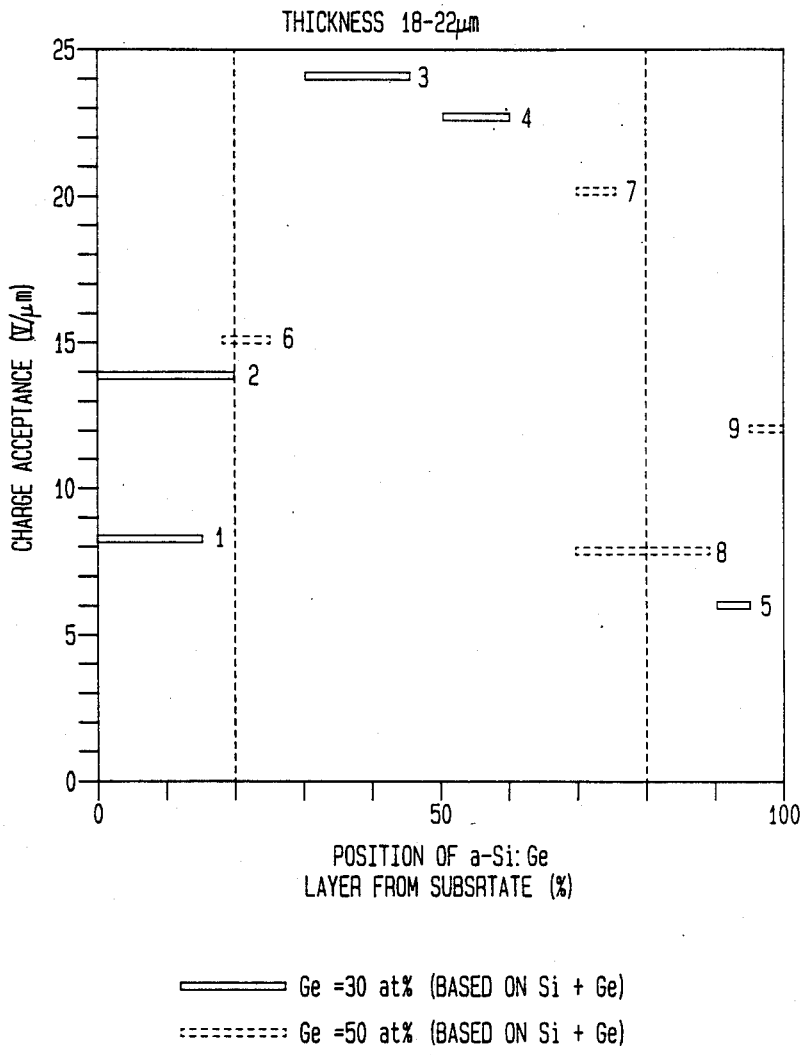
FIG. 4 and FIG. 5 show graphs illustrating the relationship between the position of a-Si:Ge layer from substrate and charging acceptance.
Figure 5:
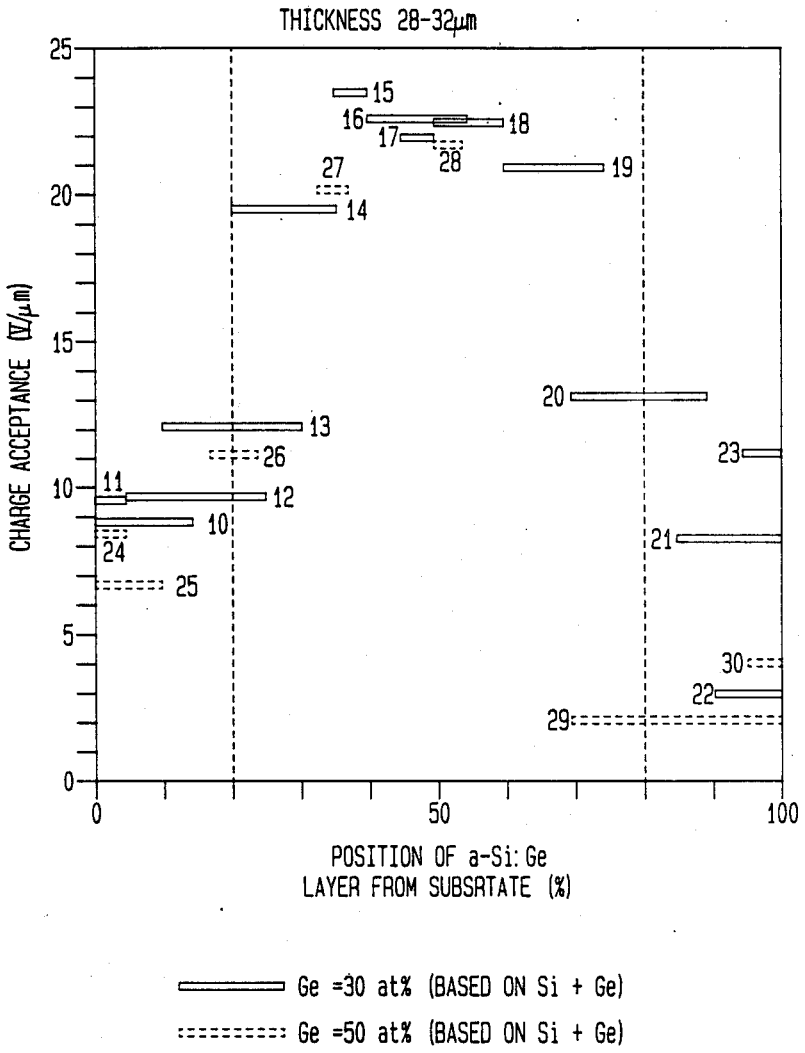

Photosensitive members having a construction as shown in Table 2 are produced in the same manner as in Example 1, and the charging capability (charge acceptance (V/μm) of every sample is measured as usual. The results are shown in FIGS. 4 and 5. Hereupon, the photosensitive members containing 50 at % of Ge are produced by setting the flow amount of $GeH_4$ gas at Step (2) on 30 sccm. In the table, thicknesses of 18–22 and 28–32 are total thickness of three layers (2), (3) and (4). Also the position is measured from the surface of the substrate (1).

TABLE 2

| sample | Thickness of three layers (μm) | Ge (at %) | Position from substrate (%) | d (μm) | $dx^2$ |
|---|---|---|---|---|---|
| 1 | 18–22 | 30 | 0–15 | 3 | 0.27 |
| 2 | | | 0–20 | 4 | 0.36 |
| 3 | | | 30–45 | 3 | 0.27 |
| 4 | | | 50–60 | 2 | 0.18 |
| 5 | | | 90–95 | 1 | 0.09 |
| 6 | | 50 | 18–25 | 1.4 | 0.35 |
| 7 | | | 70–76 | 1.2 | 0.3 |
| 8 | | | 70–90 | 4 | 1.0 |
| 9 | | | 95–100 | 1 | 0.25 |
| 10 | 28–32 | 30 | 0–15 | 4.5 | 0.405 |
| 11 | | | 0–5 | 1.5 | 0.135 |
| 12 | | | 5–25 | 6 | 0.54 |
| 13 | | | 10–30 | 6 | 0.54 |
| 14 | | | 20–35 | 4.5 | 0.405 |
| 15 | | | 35–40 | 1.5 | 0.135 |
| 16 | | | 40–55 | 4.5 | 0.405 |
| 17 | | | 45–50 | 1.5 | 0.135 |
| 18 | | | 50–60 | 3.0 | 0.27 |
| 19 | | | 60–75 | 4.5 | 0.405 |
| 20 | | | 70–90 | 6 | 0.54 |
| 21 | | | 85–100 | 4.5 | 0.405 |
| 22 | | | 90–100 | 3.0 | 0.27 |
| 23 | | | 95–100 | 1.5 | 0.135 |
| 24 | | 50 | 0–5 | 1.5 | 0.375 |
| 25 | | | 0–10 | 3.0 | 0.75 |
| 26 | | | 17–24 | 2.1 | 0.525 |
| 27 | | | 32–37 | 1.5 | 0.375 |
| 28 | | | 50–54 | 1.2 | 0.3 |
| 29 | | | 70–100 | 9.0 | 2.25 |
| 30 | | | 95–100 | 1.5 | 0.375 |

EXAMPLE 3

Figure 6:
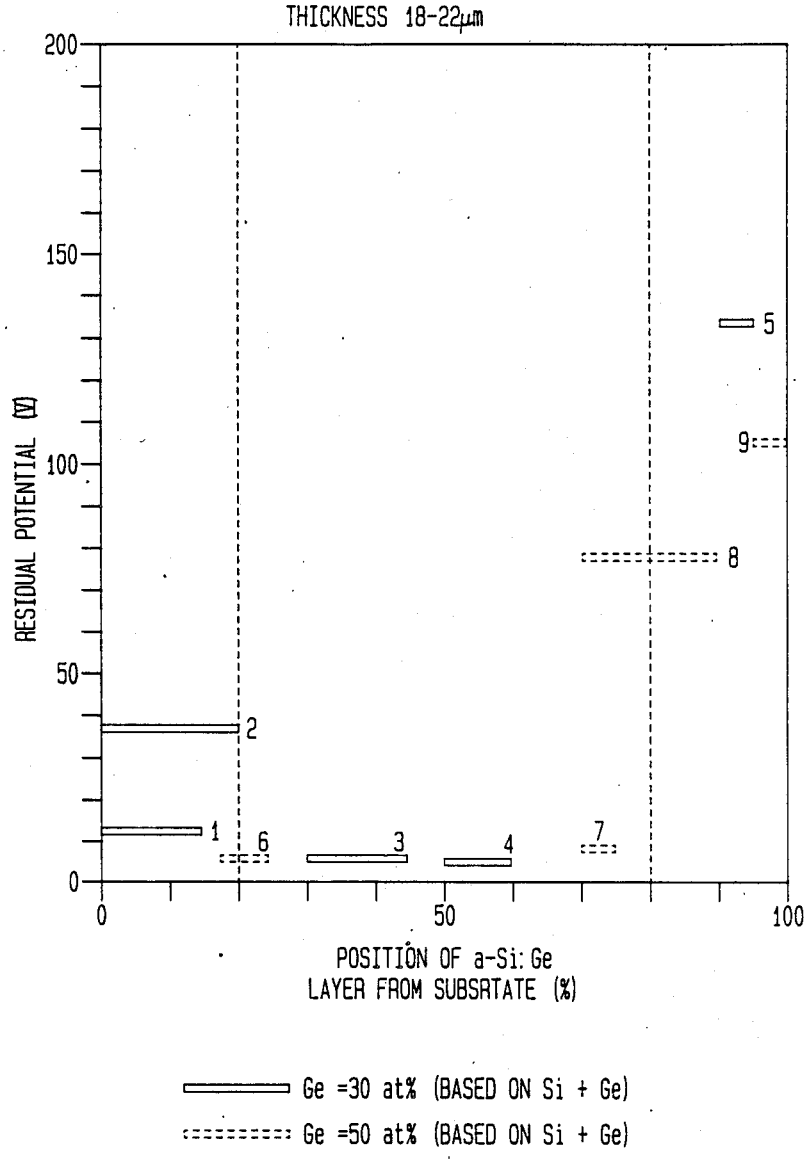
FIG. 6 and FIG. 7 show graphs illustrating the relationship between the position of a-Si:Ge layer from substrate an residual potential.

The residual potential of the photosensitive members, samples 1 to 30, prepared in Example 2 is measure as usual. The results are shown in FIGS. 6 and 7.

Figure 7:
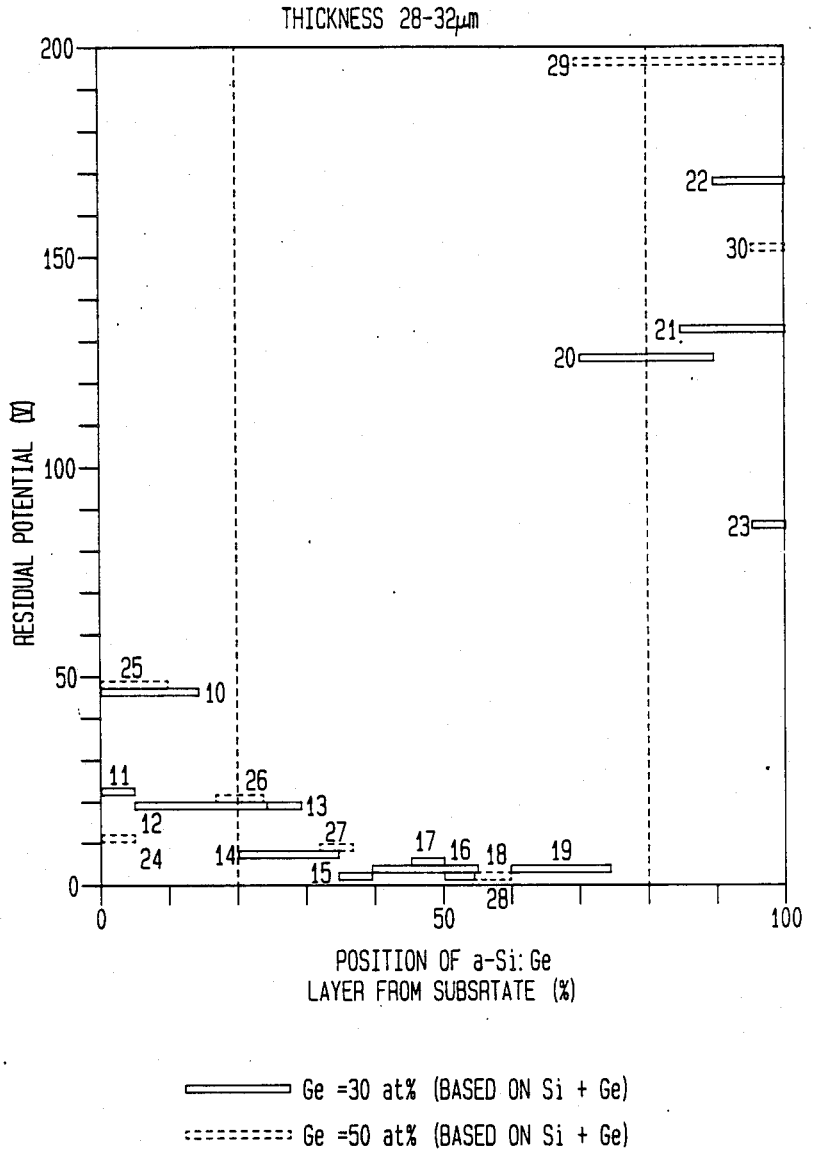

As is apparent from FIGS. 4 and 7, it is understandable that, in order to attain high charging acceptance and low residual potential, the a-Si:Ge layer in the photosensitive member should be located within a range of 20 to 80% of the thickness of the photosensitive layer.

EXAMPLE 4

Figure 8:
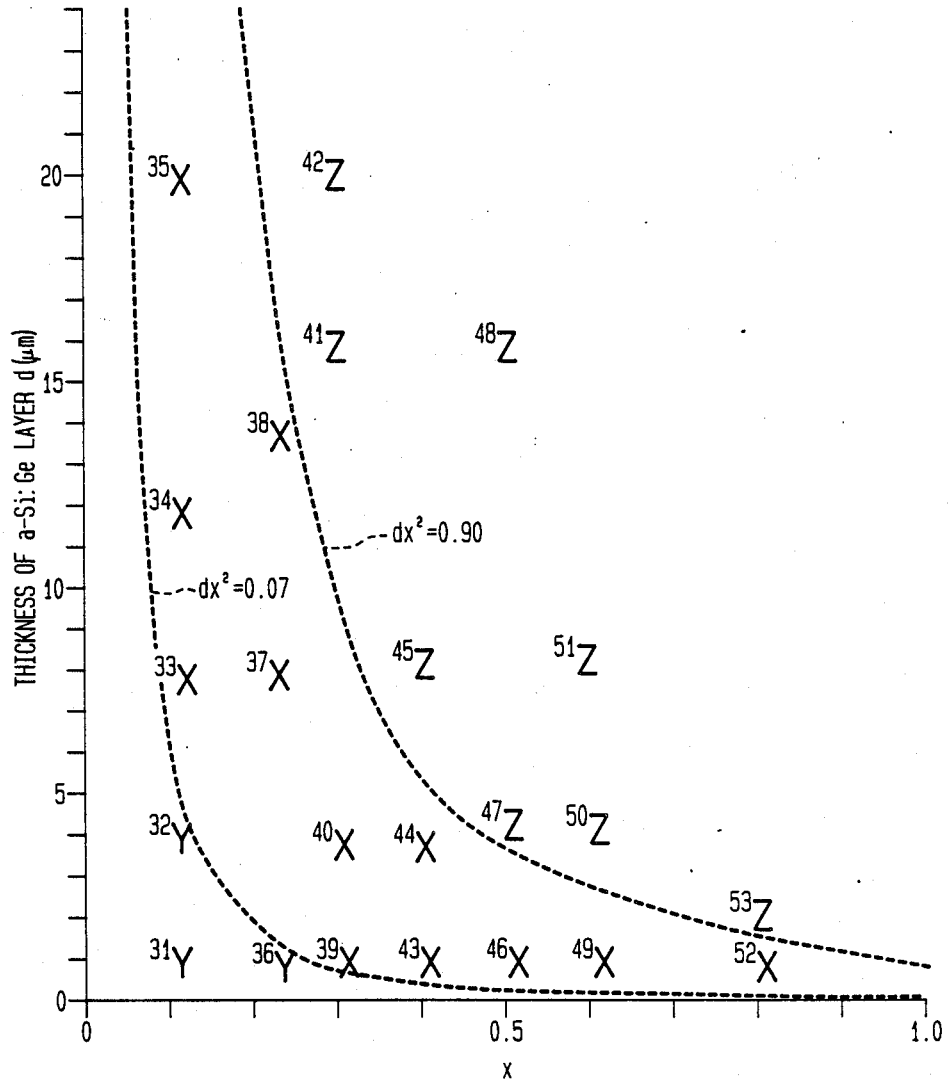
FIG. 8 shows graphs illustrating the position of $dx^2$, evaluation of charging acceptance and propriety of using on laser ray, all of which were measured with the samples obtained in Example 4.
Figure 9:
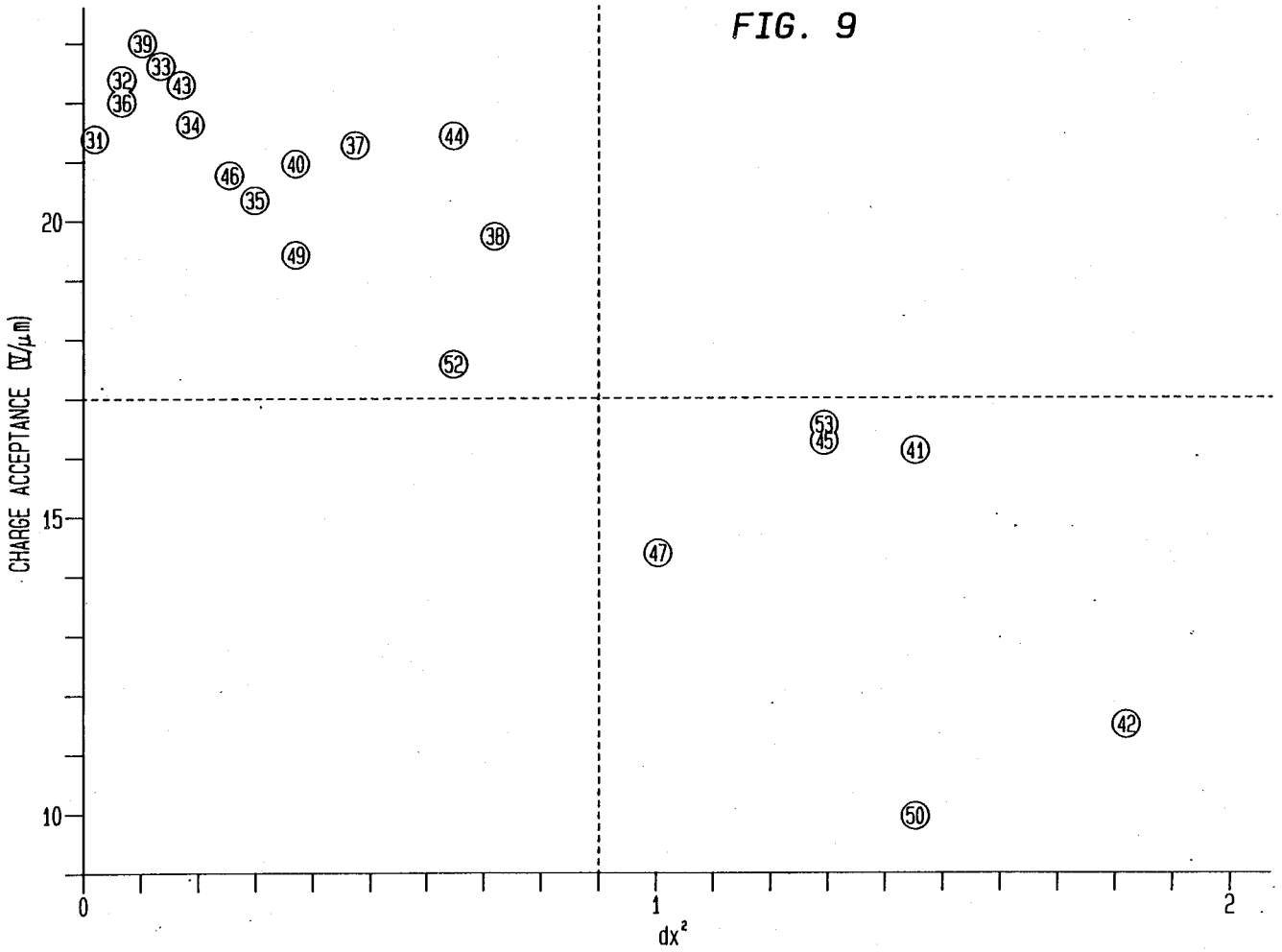
FIG. 9 shows graphs illustrating the relationship between $dx^2$ and charging acceptance.
Figure 10:
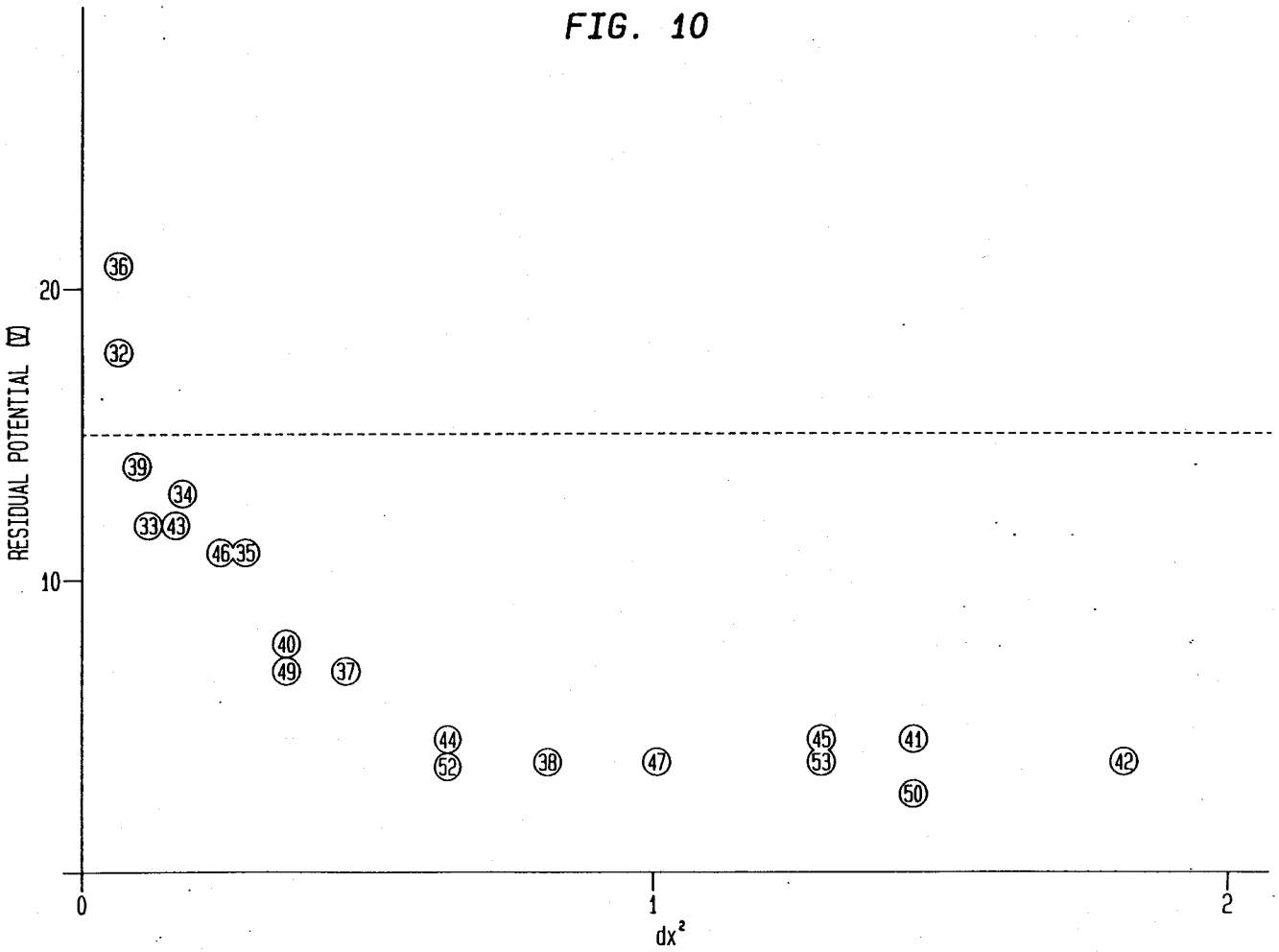
FIG. 10 shows graphs illustrating the relationship between, on the one hand, $dx^2$ and on the other hand, potential difference (dv)

Using the layer depositing condition shown in Table 3, photosensitive members (samples 31 to 53) having an a-Si/a-Si:Ge/a-Si three-layer structure are produced in the same manner as in Example 1. The thickness and position of the a-Si:Ge layer, charging acceptance and residual potential are shown in Table 4. Relationships between the thickness of a-Si:Ge layer (abscissa), Ge content (ordinate) and $dx^2$ of each sample are shown in FIG. 8. Also, relationship between $dx^2$ and charging acceptance of each sample and between $dx^2$ and interference [potential difference (dv) between the light part and dard part on interference fringes] of each sample are shown in FIGS. 9 and 10, respectively. When the dv is not more than 15 V, fringe patterns do not appear on images.

In FIG. 8, X means that the charging acceptance is good or laser ray may also be used, Y means that the charging acceptance is good but there is a problem in using laser ray, and Z means that the charging acceptance is poor. The numeral at the upper left of eash symbol shows a sample number. As is apparent from FIG. 8, photosensitive members within a range, $0.07 \leqq dx^2 \leqq 0.90$, have good charging acceptance and also can be used on laser ray.

TABLE 3

| | a-Si at substrate side | a-Si:Ge | a-Si at surface side |
|---|---|---|---|
| $H_2$ (carrier) | 490 | 484–394 | 494 |
| $SiH_4$ | 100 | 100 | 100 |
| $B_2H_6$ (200 ppm)/$H_2$ | 5 | 5 | 5 |
| ($B_2H_6/SiH_4$) | (10) | (10) | (10) |
| $O_2$ | 1 | 1 | 1 |
| $GeH_4$ | 0 | 10–100 | 0 |
| Ts (°C.) | 250 | 250 | 250 |
| Power (W) | 250 | 250 | 250 |
| Pressure (Torr) | 1 | 1 | 1 |

(Total thickness, 22–44 μm)

TABLE 4

| Sample | $GeH_4/(SiH_4 + GeH_4)$ | Ge/(Si + Ge) | Thickness (μm) | $dx^2$ | Charging acceptance [V/μm] | Residual potential [V] |
|---|---|---|---|---|---|---|
| 31 | 1/11 | 0.12 | 1 | 0.01 | 21.5 | 50 |
| 32 | 1/11 | 0.12 | 4 | 0.06 | 22.5 | 18 |
| 33 | 1/11 | 0.12 | 8 | 0.12 | 22.8 | 12 |
| 34 | 1/11 | 0.12 | 12 | 0.17 | 21.7 | 13 |
| 35 | 1/11 | 0.12 | 20 | 0.29 | 20.4 | 11 |
| 36 | 1/8 | 0.24 | 1 | 0.06 | 22.1 | 21 |
| 37 | 1/8 | 0.24 | 8 | 0.46 | 21.3 | 7 |
| 38 | 1/8 | 0.24 | 14 | 0.81 | 19.7 | 4 |
| 39 | 1/6 | 0.3 | 1 | 0.09 | 23.2 | 14 |
| 40 | 1/6 | 0.3 | 4 | 0.36 | 21 | 8 |
| 41 | 1/6 | 0.3 | 16 | 1.44 | 16.1 | 5 |
| 42 | 1/6 | 0.3 | 20 | 1.8 | 11.5 | 4 |
| 43 | 1/4.5 | 0.4 | 1 | 0.16 | 22.4 | 12 |
| 44 | 1/4.5 | 0.4 | 4 | 0.64 | 21.4 | 5 |
| 45 | 1/4.5 | 0.4 | 8 | 1.28 | 16.3 | 5 |
| 46 | 1/3.5 | 0.5 | 1 | 0.25 | 20.8 | 11 |
| 47 | 1/3.5 | 0.5 | 4 | 1 | 14.3 | 4 |
| 48 | 1/3.5 | 0.5 | 16 | 4 | 4.2 | 3 |
| 49 | 1/3 | 0.6 | 1 | 0.36 | 19.4 | 7 |
| 50 | 1/3 | 0.6 | 4 | 1.44 | 9.8 | 3 |
| 51 | 1/3 | 0.6 | 8 | 2.88 | 5.6 | 2 |
| 52 | 1/2 | 0.8 | 1 | 0.64 | 17.5 | 4 |
| 53 | 1/2 | 0.8 | 2 | 1.28 | 16.4 | 4 |

What is claimed is:

1. An electrophotosensitive member which comprises:

a substrate;

a first amorphous silicon layer having a thickness of about 5 to 30 micrometers;

an amorphous silicon:germanium photoconductive layer of about 100 Å to 20 micrometers thickness formed on said first amorphous silicon layer; and a second amorphous silicon layer of about 5 to 30 micrometers thickness formed on said amorphous silicon:germanium layer, said amorphous silicon:germanium layer being situated at a distance from said substrate in the range of 20 to 80% of the total thickness of said layers, said first amorphous silicon layer being of a conductivity type to control a majority carrier of said layer to be a polarity which is the same as the polarity of charging, and said second amorphous silicon layer being a conductivity type to control a majority carrier of said layer to be a polarity opposite to the polarity of charging.

2. An electrophotosensitive member as claimed in claim 1 wherein the composition of said amorphous silicon:germanium layer is represented by $a\text{-}Si_{(1-x)}:Ge_xH$ (x:number of Ge atoms expressed by a ratio of Ge/Si+Ge), and wherein the thickness d of said amorphous silicon:germanium layer satisfies the condition $0.07 \leqq dx^2 \leqq 0.90$.

3. An electrophotosensitive member as claimed in claim 1 wherein said first amorphous silicon layer is P-type and said second amorphous silicon layer is N-type for positive charging.

4. An electrophotosensitive member as claimed in claim 3 wherein said first amorphous silicon layer includes less than about 200 ppm of an impurity element in Group IIIA of the Periodic Table.

5. An electrophotosensitive member as claimed in claim 3 wherein said second amorphous silicon layer includes less than about 50 ppm of an impurity element in Group VA of the Periodic Table.

6. An electrophotosensitive member as claimed in claim 1 wherein said first amorphous silicon layer is N-type and said second amorphous silicon layer is P-type for negative charging.

7. An electrophotosensitive member as claimed in claim 6 wherein said second amorphous silicon layer includes less than about 200 ppm of an impurity element in Group IIIA of the Periodic Table.

8. An electrophotosensitive member as claimed in claim 6 wherein said first amorphous silicon layer includes less than about 50 ppm of an impurity element in Group VA of the Periodic Table.

9. An electrophotosensitive member as claimed in claim 1 wherein said first amorphous silicon layer further includes oxygen in an amount of about 0.05 to 5 atomic %.

10. An electrophotosensitive member as claimed in claim 1 wherein said second amorphous silicon layer further includes carbon in an amount of less than about 35 atomic %.

11. An electrophotosensitive member which comprises on a substrate, in order, a first amorphous silicon layer having a thickness of about 5 to 30 micrometers, an amorphous silicon:germanium photoconductive layer having a thickness of about 100 Å to 20 micrometers and a second amorphous silicon layer having a thickness of about 5 to 30 micrometers, said amorphous silicon:germanium layer being situated at a distance from said substrate in the range of 20 to 80% of the total thickness of said layers and further, said first amorphous silicon layer being of a conductivity type to control a majority carrier of said layer to be a polarity which is the same as the polarity of charging, and said second amorphous silicon layer being a conductivity type to control a majority carrier of said layer to be a polarity opposite to the polarity of charging, the relationship between the thickness d of said amorphous silicon:germanium layer, whose composition is represented by a-$Si_{(1-x)}$:$Ge_xH$ (x:number of Ge atoms expressed by a ratio of Ge/Si+Ge), and the Ge concentration x satisfying the following equation of $0.07 \leqq dx^2 \leqq 0.90$.

* * * * *